US009196957B2

(12) United States Patent
Kim et al.

(10) Patent No.: US 9,196,957 B2
(45) Date of Patent: Nov. 24, 2015

(54) MIMO ANTENNA FOR IMPROVED ISOLATION

(75) Inventors: Jin-Myung Kim, Incheon (KR); Chang-Won Jung, Seoul (KR); In-Su Yeom, Seoul (KR)

(73) Assignees: MOBITECH CORP, Seoul (KR); Seoul National University of Technology Center for Industry Collaboration, Seoul (KR)

( * ) Notice: Subject to any disclaimer, the term of this patent is extended or adjusted under 35 U.S.C. 154(b) by 124 days.

(21) Appl. No.: 13/643,987

(22) PCT Filed: Apr. 28, 2011

(86) PCT No.: PCT/KR2011/003138

§ 371 (c)(1),
(2), (4) Date: Jan. 14, 2013

(87) PCT Pub. No.: WO2011/136576

PCT Pub. Date: Nov. 3, 2011

(65) Prior Publication Data

US 2013/0135168 A1 May 30, 2013

(30) Foreign Application Priority Data

Apr. 28, 2010 (KR) ..... 10-2010-0039611

(51) Int. Cl.

| | |
|---|---|
| ***H01Q 1/52*** | (2006.01) |
| ***H01Q 9/42*** | (2006.01) |
| ***H01Q 21/28*** | (2006.01) |

(52) U.S. Cl.

CPC ..... *H01Q 1/521* (2013.01); *H01Q 9/42* (2013.01); *H01Q 21/28* (2013.01)

(58) Field of Classification Search

CPC ..... H01Q 1/521; H01Q 1/243; H01Q 1/2266
USPC ..... 343/841, 702, 893
See application file for complete search history.

(56) References Cited

U.S. PATENT DOCUMENTS

| | | | | |
|---|---|---|---|---|
| 2007/0182643 | A1* | 8/2007 | Li et al. | 343/702 |
| 2009/0073047 | A1* | 3/2009 | Le Bolzer et al. | 343/700 MS |
| 2009/0102742 | A1* | 4/2009 | Park et al. | 343/876 |
| 2011/0115687 | A1* | 5/2011 | Huang | 343/843 |
| 2011/0163937 | A1 | 7/2011 | Jung et al. | |

FOREIGN PATENT DOCUMENTS

| | | | |
|---|---|---|---|
| CN | 101281995 | A | 10/2008 |
| CN | 101316008 | A | 12/2008 |
| EP | 2053692 | A2 | 4/2009 |

(Continued)

*Primary Examiner* — Dieu H Duong
(74) *Attorney, Agent, or Firm* — TechLaw LLP

(57) ABSTRACT

A MIMO antenna for improving isolation is disclosed. The disclosed antenna includes a dielectric feature; a ground plane included in a first layer of the dielectric feature; a first radiator, which is electromagnetically joined with a first feed point, configured to radiate a first RF signal, and joined with the ground plane; a second radiator, which is electromagnetically joined with a second feed point, configured to radiate a second RF signal, and joined with the ground plane; and a connector line, which is joined with a particular point of the first radiator and with a particular point of the second radiator to connect the first radiator with the second radiator. The disclosed antenna can improve isolation properties between multiple antennas and can ensure adequate isolation properties even when the distances between multiple antennas are set to be relatively small.

4 Claims, 3 Drawing Sheets

(56) References Cited

FOREIGN PATENT DOCUMENTS

| | | |
|---|---|---|
| KR | 10-2006-0114062 | 11/2006 |
| KR | 10-2009-0038724 | 4/2009 |
| KR | 10-2009-0039103 | 4/2009 |
| KR | 10-2010-0030522 | 3/2010 |

* cited by examiner

MIMO ANTENNA FOR IMPROVED ISOLATION

TECHNICAL FIELD

The present invention relates to an internal antenna, more particularly to an internal antenna having improving isolation properties to prevent interference between antennas.

BACKGROUND ART

With the rapidly increasing demands for multimedia services, there is a demand for mobile communication systems to provide high-speed data transmissions in a reliable manner. In order to enable high-speed data transmission over a wireless channel, which uses limited bandwidth and power, it is essential to increase capacity. In recent times, there has been a continued increase of interest in technologies for improving capacity.

In a wireless communication environment, the reliability of reception signals may be greatly degraded by fading, shadowing, wave attenuation, interference, etc. Thus, in order to enable high-speed data communication, these wireless channel properties must be overcome, or an alternative is required which utilizes such qualities. A technology proposed in answer to such needs is the MIMO antenna technology.

The MIMO antenna technology uses a spatial multiplexing technique for transmitting data at high speeds without further increasing the system's bandwidth, by using multiple antennas at the transmitter or receiver to transmit different data simultaneously.

A MIMO antenna has an arrayed antenna structure that uses multiple radiators, and since a multiple number of radiators are used, there can be interference occurring between the radiators. Such interference can distort the radiating pattern or create a mutual coupling effect among the radiators.

In order to minimize interference between radiators, a MIMO antenna may use an isolation element, i.e. a separate feature, or may use a structure in which the radiators are widely separated from one another.

With existing isolation methods obtained from prior research, providing the desired isolation basically involves providing a sufficient distance between two antennas, even in cases where a separate isolation element is used.

However, since the demand for smaller terminals is an ongoing requirement, and since providing a sufficient distance between multiple antennas not only is very difficult but also runs contrary to providing smaller terminal sizes, there is a need for an isolation technique that can be applied for multiple antennas that are positioned relatively closely to one another.

DISCLOSURE

Technical Problem

An aspect of the present invention, devised to resolve the problems above, is to propose a MIMO antenna that can improve isolation properties between multiple antennas.

Another aspect of the present invention is to provide a MIMO antenna that can ensure adequate isolation properties even when the distances between multiple antennas are set to be relatively small.

Other objectives of the present invention can be readily derived by a person skilled in the art from the embodiments of the present invention described below.

Technical Solution

One aspect of the present invention provides a MIMO (multiple-input multiple-output) antenna for improving isolation that includes: a dielectric feature; a ground plane included in a first layer of the dielectric feature; a first radiator, which is electromagnetically joined with a first feed point, configured to radiate a first RF signal, and joined with the ground plane; a second radiator, which is electromagnetically joined with a second feed point, configured to radiate a second RF signal, and joined with the ground plane; and a connector line, which is joined with a particular point of the first radiator and with a particular point of the second radiator to connect the first radiator with the second radiator.

The first RF signal and the second RF signal may be of the same frequency.

The length of the connector line can be set to $\lambda/4$, where $\lambda$ the operating frequency of the first radiator and the second radiator.

The antenna can further include a coupling member, which may be joined to a second layer of the dielectric feature, and which may overlap the ground plane one over the other.

A first end of the coupling member may be adjacent to a joining portion of the first radiator and the ground plane, while a second end of the coupling member may be adjacent to a joining portion of the second radiator and the ground plane.

Preferably, the coupling member may have a size capable of radiating the radiation frequencies of the first radiator and the second radiator.

Another aspect of the present invention provides a MIMO antenna for improving isolation that includes: a dielectric feature; a ground plane included in a first layer of the dielectric feature; a first radiator, which is electromagnetically joined with a first feed point, configured to radiate a first RF signal, and joined with the ground plane; a second radiator, which is electromagnetically joined with a second feed point, configured to radiate a second RF signal, and joined with the ground plane; and a coupling member, which is joined to a second layer of the dielectric feature, and which overlaps the ground plane one over the other.

Advantageous Effects

An antenna according to an embodiment of the present invention can improve isolation properties between multiple antennas and can ensure adequate isolation properties even when the distances between multiple antennas are set to be relatively small.

MODE FOR INVENTION

A MIMO antenna for improving isolation according to a preferred embodiment of the present invention will be described below in more detail with reference to the accompanying drawings.

Figure 1:
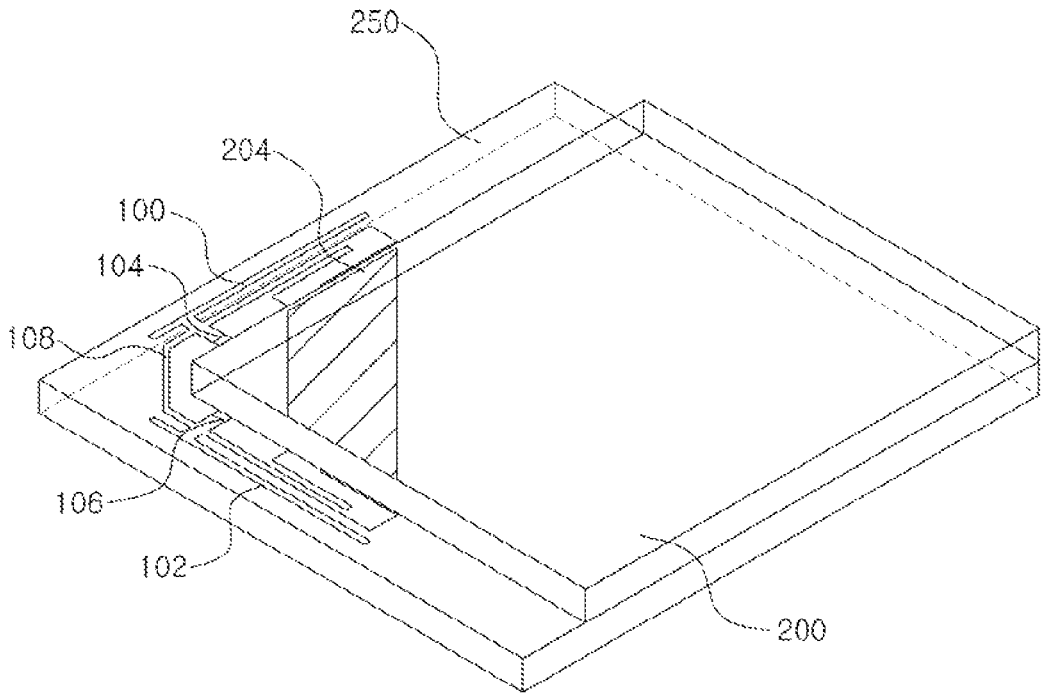
FIG. 1 is a perspective view of a MIMO antenna for improving isolation according to an embodiment of the present invention.
Figure 2:
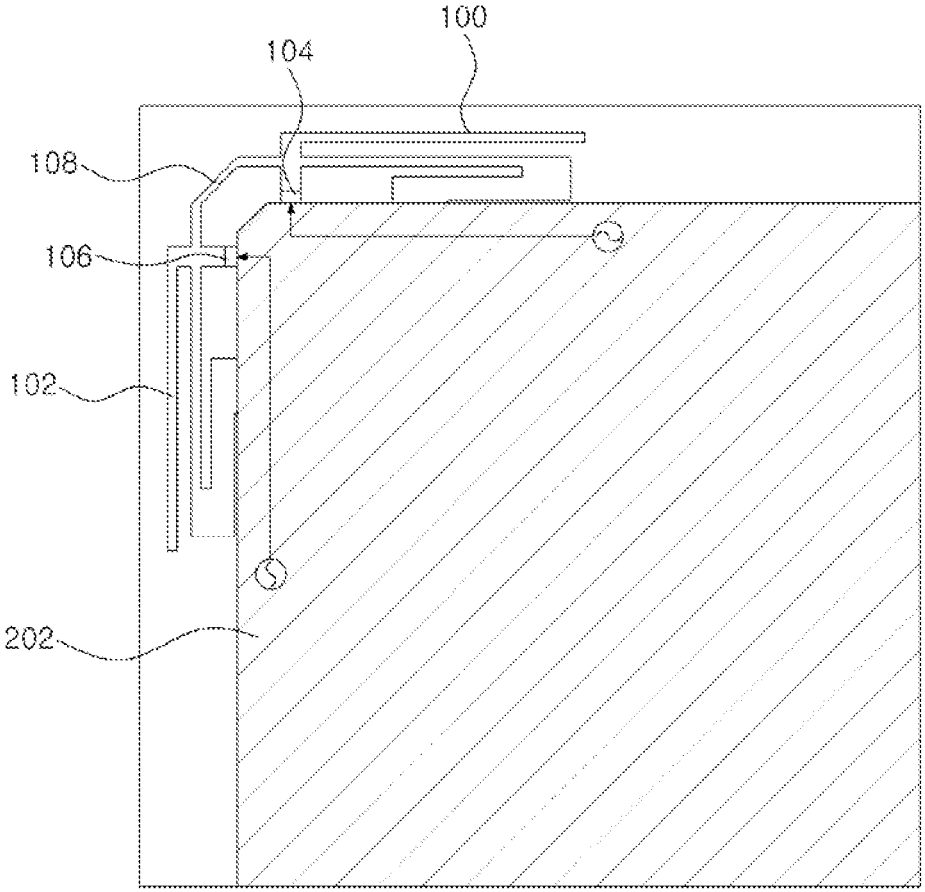
FIG. 2 is a bottom view of a MIMO antenna for improving isolation according to an embodiment of the present invention.
Figure 3:
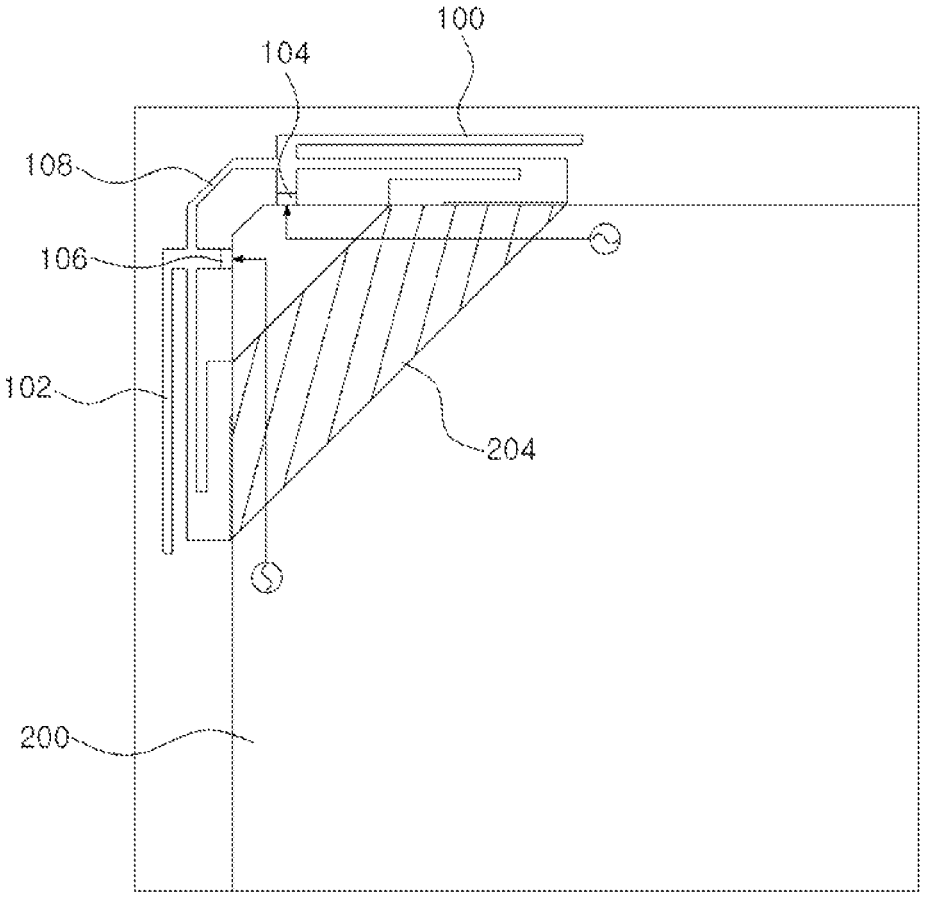
FIG. 3 is a top view of a MIMO antenna for improving isolation according to an embodiment of the present invention.

FIG. 1 is a perspective view of a MIMO antenna for improving isolation according to an embodiment of the present invention, FIG. 2 is a bottom view of a MIMO antenna for improving isolation according to an embodiment of the present invention, and FIG. 3 is a top view of a MIMO antenna for improving isolation according to an embodiment of the present invention.

Referring to FIG. 1 through FIG. 3, a MIMO antenna for improving isolation according to an embodiment of the present invention can include a first radiator 100, a second radiator 102, a first feed point 104, a second feed point 106, a connector line 108, a dielectric feature 200, a ground plane 202, and a coupling member 204.

The dielectric feature 200 may serve as the body to which the ground plane 202 and the coupling member 204 may be joined. It would be apparent to the person skilled in the art that the dielectric feature can be selected from various types and can be, for example, a substrate such as a PCB (printed circuit board).

The ground plane 202 may be formed at a lower portion of the dielectric feature 200, may be made of a metallic material, and may be kept electrically grounded.

The first radiator 100 may be fed with a signal through the first feed point 104 and may radiate a first RF signal. While FIG. 1 illustrates a structure in which the first radiator 100 extends in the same plane as the dielectric feature 200, the first radiator 100 can also be formed perpendicularly to the dielectric feature 200.

The first radiator 100 may be connected with the first feed point 104 and also electrically joined with the ground plane 202. That is, the first radiator 100 may have the feeding structure of the PIFA (planar inverted-F antenna), connecting to both the feed point 104 and the ground plane 202.

When a coaxial cable is used for the feeding line of the first radiator 100, the conductor within the coaxial cable can be joined to the first feed point 104, and the outer core of the coaxial cable can be joined to the ground plane 202.

However, the form of the first radiator 100 illustrated in FIG. 1 is merely an example, and it would be apparent to a person skilled in the art that various forms can be adopted as long as the electrical length required for resonance of the RF signals is satisfied.

The second radiator 102 may be fed with a signal through the second feed point 106 and may radiate a second RF signal. While FIG. 1 illustrates a structure in which the second radiator 102 extends in the same plane as the dielectric feature 200, the second radiator 102 can also be formed perpendicularly to the dielectric feature 200.

The second radiator 102 may also have a PIFA feeding structure, connecting to both the second feed point 106 and at the same time also electrically joining with the ground plane 202.

The form of the second radiator 102 illustrated in FIG. 1 is also merely an example, and it would be apparent to a person skilled in the art that various forms can be adopted as long as the electrical length required for resonance of the RF signals is satisfied. Although FIG. 1 illustrates the second radiator 102 as having a form identical to that of the first radiator, it is not necessary for the form of the second radiator to be the same as that of the first radiator.

The antenna according to an embodiment of the present invention may be a MIMO antenna, the first RF signal radiated from the first radiator 100 and the second RF signal radiated from the second radiator 102 may be different signals fed independently, and the frequencies of the two signals may be the same.

When two radiators that radiate different signals are adjacent to each other, interference can occur between the two radiators, and such interference may act as a major cause of performance degradation in the MIMO antenna.

An aspect of the present invention proposes a configuration that employs a connector line 108 and a coupling member 204 to suppress interference between two adjacent radiators.

The connector line 108 may be joined to particular points of the first radiator 100 and second radiator 102 and may thus electrically connect the first radiator 100 and second radiator 102. The connector line 108 may have a length corresponding to $\lambda/4$, where $\lambda$ is an operating frequency of the first radiator 100 and the second radiator 102.

As the connector line 108 is given a length of $\lambda/4$, the path from the first radiator to the second radiator and the path from the second radiator to the first radiator would appear to be electromagnetically blocked, whereby interference from either radiator can be suppressed.

This suppression of interference using the connector line 108 having a length of $\lambda/4$ has the advantage that the interference between radiators can be suppressed with a relatively simple structure, even if the radiators are relatively close to each other.

The coupling member 204 included at an upper portion of the dielectric feature 200 may operate as another element for suppressing interference between two radiators. While FIG. 1 through FIG. 3 illustrate the ground plane 202 as being positioned under the dielectric feature 200 and illustrate the coupling member 204 as being positioned over the dielectric feature 200, the positional relationship concerning which is above and which is below can be modified as necessary, provided that the ground plane 202 and the coupling member 204 are positioned in different layers.

In general, the ground of the terminal is jointly used as the ground for the MIMO antenna, but the jointly used ground plane 202 can cause interference between radiators. The coupling member 204 may suppress such interference between radiators caused by the ground plane 202.

The coupling member 204 may be positioned at a portion overlapping the ground plane 202 one over the other, and a first end from among the two ends of the coupling member 204 may be adjacent to a joining portion of the first radiator 100 to the ground plane 202, while a second end from among the two ends of the coupling member 204 may be adjacent to a joining portion of the second radiator 102 to the ground plane 202.

According to an embodiment of the present invention, the size of the coupling member 204 may preferably be set to a size capable of radiating the radiation frequencies of the first radiator and the second radiator.

Because of the coupling member 204, coupling may be formed between the ground plane 202 and the coupling member 204, where such coupling may suppress interference between the two radiators by cancelling out the surface current on the surface of the ground plane 202 corresponding to the operating frequency of the first radiator and second radiator.

Here, the coupling member 204 can be interpreted as an inductance component in a circuit, and the separated space between the coupling member 204 and the ground plane 202 can be interpreted as a capacitance component. Thus, the space where the coupling member 204 and the ground plane 202 overlap can be interpreted as a type of band-stop filter having an inductor and a capacitor connected in parallel, and the addition of the coupling member 204 makes it possible to block the surface current in a certain frequency.

While FIG. 1 illustrates another dielectric feature 250 to which the dielectric feature 200 and the radiators 100, 102 are joined, the dielectric feature 250 can be omitted as necessary.

While the present invention has been described with reference to particular embodiments, it is to be appreciated that various changes and modifications can be made by those skilled in the art without departing from the spirit and scope of the present invention as defined by the scope of claims set forth below.

The invention claimed is:

1. A MIMO (multiple-input multiple-output) antenna for improving isolation, the MIMO antenna comprising:

a dielectric feature;

a ground plane included in a first layer of the dielectric feature;

a first radiator electromagnetically joined with a first feed point and configured to radiate a first RF signal, the first radiator joined with the ground plane;

a second radiator electromagnetically joined with a second feed point and configured to radiate a second RF signal, the second radiator joined with the ground plane;

a connector line joined with a particular point of the first radiator and with a particular point of the second radiator to connect the first radiator with the second radiator; and a coupling member joined to a second layer of the dielectric feature, the coupling member overlapping a portion of the ground plane one over the other and not overlapping the first radiator and the second radiator, wherein the coupling member has a first end thereof adjacent to a joining portion of the first radiator and the ground plane and has a second end thereof adjacent to a joining portion of the second radiator and the ground plane, and wherein the coupling member is not electrically connected to the ground plane.

2. The MIMO antenna of claim 1, wherein the first RF signal and the second RF signal are of a same frequency.

3. The MIMO antenna of claim 2, wherein the connector line has a length of$\lambda/4$, $\lambda$ being an operating frequency of the first radiator and the second radiator.

4. The MIMO antenna of claim 1, wherein the coupling member has a size capable of radiating a radiation frequency of the first radiator and the second radiator.

* * * * *